US011975901B2

(12) United States Patent
Bach

(10) Patent No.: US 11,975,901 B2
(45) Date of Patent: May 7, 2024

(54) RFID-EQUIPPED PRESSURE CHAMBER FOR KEG

(71) Applicant: Carlsberg Breweries A/S, Copenhagen V (DK)

(72) Inventor: Peter Bach, Copenhagen V (DK)

(73) Assignee: Carlsberg Breweries A/S, Copenhagen V (DK)

( * ) Notice: Subject to any disclaimer, the term of this patent is extended or adjusted under 35 U.S.C. 154(b) by 144 days.

(21) Appl. No.: 17/762,538

(22) PCT Filed: Sep. 23, 2020

(86) PCT No.: PCT/EP2020/076493
§ 371 (c)(1),
(2) Date: Mar. 22, 2022

(87) PCT Pub. No.: WO2021/058520
PCT Pub. Date: Apr. 1, 2021

(65) Prior Publication Data

US 2022/0355971 A1 Nov. 10, 2022

(30) Foreign Application Priority Data

Sep. 23, 2019 (EP) ..... 19199007

(51) Int. Cl.
*G08B 21/00* (2006.01)
*B65D 8/00* (2006.01)

(52) U.S. Cl.
CPC ..... *B65D 7/045* (2013.01); *B65D 2203/10* (2013.01)

(58) Field of Classification Search
CPC .... B65D 7/045; B65D 2203/10; B65D 77/06; B65D 51/245; B65D 53/00; B65D 85/72;
(Continued)

(56) References Cited

U.S. PATENT DOCUMENTS 6,628,237 B1 * 9/2003 Forster ..... H01Q 13/10 343/746
2017/0337535 A1 11/2017 Jones
(Continued)

FOREIGN PATENT DOCUMENTS

DE 202013007693 U1 10/2013
GB 2346604 A * 8/2000 ..... B65D 7/045
WO 2007/019848 A2 2/2007

OTHER PUBLICATIONS

PCT International Search Report and Written Opinion for International Application No. PCT/EP2020/076493, entitled "RFID-equipped pressure chamber for keg," dated Nov. 16, 2020.

*Primary Examiner* — Mark S Rushing
(74) *Attorney, Agent, or Firm* — Hamilton, Brook, Smith & Reynolds, P.C.

(57) ABSTRACT

The present disclosure relates to a radio-frequency identification-equipped pressure chamber for a beverage container, said pressure chamber comprising: a lid part; a base part, said lid and said base part defining a sealed inner space for accommodating and encapsulating said beverage container, said base part or lid part comprising an inner connector part adapted to be engaged to a corresponding beverage container outlet, said inner connector part arranged on an inside of the base part or lid part; and an outer substantially annular gasket part arranged on the inside of the base part or lid part and surrounding the inner connector part, said outer substantially annular gasket part adapted to be engaged with a corresponding hollow annular space of a closure of the beverage container, the outer substantially annular gasket part comprising a substantially planar annular antenna adapted to propagate radio waves to a radio-frequency identification tag arranged on an outer rim of the closure. The disclosure further relates to pressure system for a beverage comprising a collapsible beverage container and a
(Continued)

pressure chamber, wherein the pressure system includes RFID capabilities.

19 Claims, 8 Drawing Sheets

(58) Field of Classification Search
CPC .. B67D 1/0462; B67D 1/0835; B67D 1/0858; B67D 1/0888; G06K 19/07773
See application file for complete search history.

(56) References Cited

U.S. PATENT DOCUMENTS

| | | | | |
|---|---|---|---|---|
| 2020/0172387 | A1* | 6/2020 | Hershberger | B67D 1/0871 |
| 2021/0024341 | A1* | 1/2021 | Christiansen | B67D 1/0857 |

* cited by examiner

RFID-EQUIPPED PRESSURE CHAMBER FOR KEG

This application is the U.S. National Stage of International Application No. PCT/EP2020/076493, filed Sep. 23, 2020, which designates the U.S., published in English, and claims priority under 35 U.S.C. § 119 or 365(c) to European Application No. 19199007.6, filed Sep. 23, 2019. The entire teachings of the above applications are incorporated herein by reference.

The present disclosure relates to a radio-frequency identification (RFID)-equipped pressure chamber for a beverage container, in particular a single use collapsible beverage container. The disclosure further relates to a pressure system comprising a radio-frequency identification-equipped pressure chamber and a collapsible beverage container comprising a radio-frequency identification tag.

BACKGROUND OF INVENTION

Beverage dispensing systems are typically used in beverage dispensing establishments for efficiently dispensing large quantities of beverage. Typically, beverage dispensing systems are used to dispense carbonated alcoholic beverages such as draught beer and cider. However, also non-alcoholic beverages such as non-alcoholic beers, soft drinks and non-carbonated beverages such as wine and fruit juice may be dispensed using a beverage dispensing system.

Professional beverage dispensing systems typically dispense beverage provided in large beverage kegs. Such beverage kegs may for instance hold 20-50 L of beverage for a professional beverage dispensing system for allowing typically 50-100 beverage dispensing operations before needing to exchange the beverage keg. Typically, beverage kegs are made of solid materials such as steel and re-filled a number of times. In between each filling, the beverage kegs are carefully cleaned. More recently, systems having collapsible and single-use kegs have been developed, at least partly due to hygiene concerns. Such beverage dispensing systems, using collapsible beverage kegs, can have the beverage keg installed or placed in a pressure chamber. Thus, while there is a need to pressurize conventional steel kegs with $CO_2$, for instance by means of a $CO_2$-cartridge connected to the keg during dispensing, single use beverage systems, such as the applicant's DraughtMaster™, or the bag in container systems such as Heineken Blade® or BeerTender® or Anheusher-Bush InBev PureDraught®, uses air from a pressure source, e.g. an air compressor, to push the beer out and collapsing the keg or bag inside the container (hereinafter just termed keg), which means that nothing touches the beer from when it leaves the brewery until it goes in the beverage recipient, e.g. beer glass. Accordingly, the beverage stored in such collapsible beverage container is pre-carbonized or potentially pre-mixed with nitrogen when dispensing English type beer such as ales and stouts. When dispensing the beverage, the pressure fluid e.g. compressed air, is allowed to enter the pressure chamber, causing the beverage keg to collapse while dispensing the beverage. The volume of the beverage keg is reduced corresponding to the amount of dispensed beverage. The collapsible beverage kegs are preferably made of flexible and disposable material such as plastic.

In order to manage and keep track of the replaceable beverage containers, the containers may be equipped with RFID tags, such as near field communication (NFC) tags. Besides having a unique identification, the system can, for example, extract information about the beverage, such as type of beverage, volume of the container, date and/or origin of production, alcohol percentage if applicable, etc., either directly from the tag or by processing a database. The use of RFID tags is known for steel kegs, and more recently, also for beverage systems comprising single use collapsible kegs. However, the fact that the collapsible beverage kegs are installed in a pressure chamber, under a number of physical constraints, introduces technical challenges and inconveniences regarding the communication between the RFID interrogator and the RFID tag. It is an object of the present disclosure to overcome one or more of these challenges and inconveniences.

SUMMARY OF INVENTION

The present disclosure relates, in a first embodiment, to a radio-frequency identification-equipped pressure chamber for a beverage container, said pressure chamber comprising:

- a lid part;
- a base part, said lid and said base part defining a sealed inner space for accommodating and encapsulating said beverage container, said base part or lid part comprising:
  - an inner connector part adapted to be engaged to a corresponding beverage container outlet, said inner connector part arranged on an inside of the base part or lid part; and
  - an outer substantially annular gasket part arranged on the inside of the base part or lid part and surrounding the inner connector part, said outer substantially annular gasket part adapted to be engaged with a corresponding hollow annular space of a closure of the beverage container, the outer substantially annular gasket part comprising a substantially planar annular antenna adapted to propagate radio waves to a radio-frequency identification tag arranged on an outer rim of the closure.

The outer substantially annular gasket part shall be seen a three-dimensional body, i.e. it has an annular shape with a certain height. The outer substantially annular gasket part may thereby be a toroid or the upper-half of a toroid. The shape of the toroid is not necessarily fully regular and may be revolved based on a rectangular, square and/or circle or a combination. The function of the outer substantially annular gasket part is to be introduced into a corresponding hollow part of the closure to seal the connecting between the tapping line and the container.

The base part and the lid part constitute the sealed pressure chamber for encapsulating the collapsible keg. The keg, which has a beverage container outlet, will typically also have a closure for cooperation with a coupler of a beverage dispensing system, preferably through the base part. The closure may have an outer rim, on which an RFID tag, such as an NFC tag, may be arranged, as illustrated in, for example, FIG. 1 and FIG. 5. The pressure chamber is typically a fixed installation, whereas the collapsible keg is typically single use and replaced when it has been emptied. According to one embodiment of the invention, the base part is equipped with an outer substantially annular gasket part arranged on the inside of the base part, such as in the bottom of the base part of the pressure chamber. "Annular" shall, in this regard, be construed broadly as a shape having a through hole and a minimum height that makes it suitable for introducing it into a corresponding hollow annular space of the closure of the collapsible beverage container. The annular shape may be seen as a donut shape with possible irregularities. When placing a keg in the pressure chamber, the substantially annular gasket part is introduced into the corresponding hollow annular space of the closure into a sealed configuration. If a substantially planar annular antenna is arranged on the substantially annular gasket part, the antenna can also be introduced into the hollow annular space of the closure. From a position in the hollow annular space it can be arranged and adapted to propagate radio waves to the RFID tag arranged of an outer rim of the closure, thereby interrogating the RFID tag locally for the specific keg. Preferably, the substantially planar annular antenna is an omnidirectional antenna.

Further details regarding the physical constraints, integration of the substantially planar annular antenna (interrogation antenna), positioning of the interrogation antenna and RFID tag, antenna design and other aspects of the invention are set forth in the following detailed description of the invention.

The disclosure further relates to a pressure system for a beverage comprising:

- a collapsible beverage container comprising a closure with a beverage outlet, the closure having an outer rim and a radio-frequency identification tag arranged on said rim;
- a pressure chamber comprising:
  - a lid part;
  - a base part, said lid and said base part defining a sealed inner space for accommodating and encapsulating the collapsible beverage container, said base part or lid part comprising:
    - an inner connector part adapted to be engaged to the beverage outlet, said inner connector part arranged on an inside of the base part or lid part; and
    - an outer substantially annular gasket part arranged on the inside of the base part or lid part and surrounding the inner connector part, said outer substantially annular gasket part adapted to be engaged with a corresponding hollow annular space of the closure of the collapsible beverage container, the outer substantially annular gasket part comprising a substantially planar annular antenna adapted to propagate radio waves to the radio-frequency identification tag.

The "pressure system" can thereby be seen as an assembly comprising a collapsible beverage container and a pressure chamber for accommodating and encapsulating the collapsible beverage container. In this assembly the beverage chamber and the collapsible keg may comprise a two-way radio transmitter-receiver connection using a given frequency. The pressure system may be part of a beverage dispensing system in the form of a modular system comprising a plurality of collapsible beverage containers and pressure chambers sharing a common tapping line.

DETAILED DESCRIPTION OF THE INVENTION

Figure 1A:
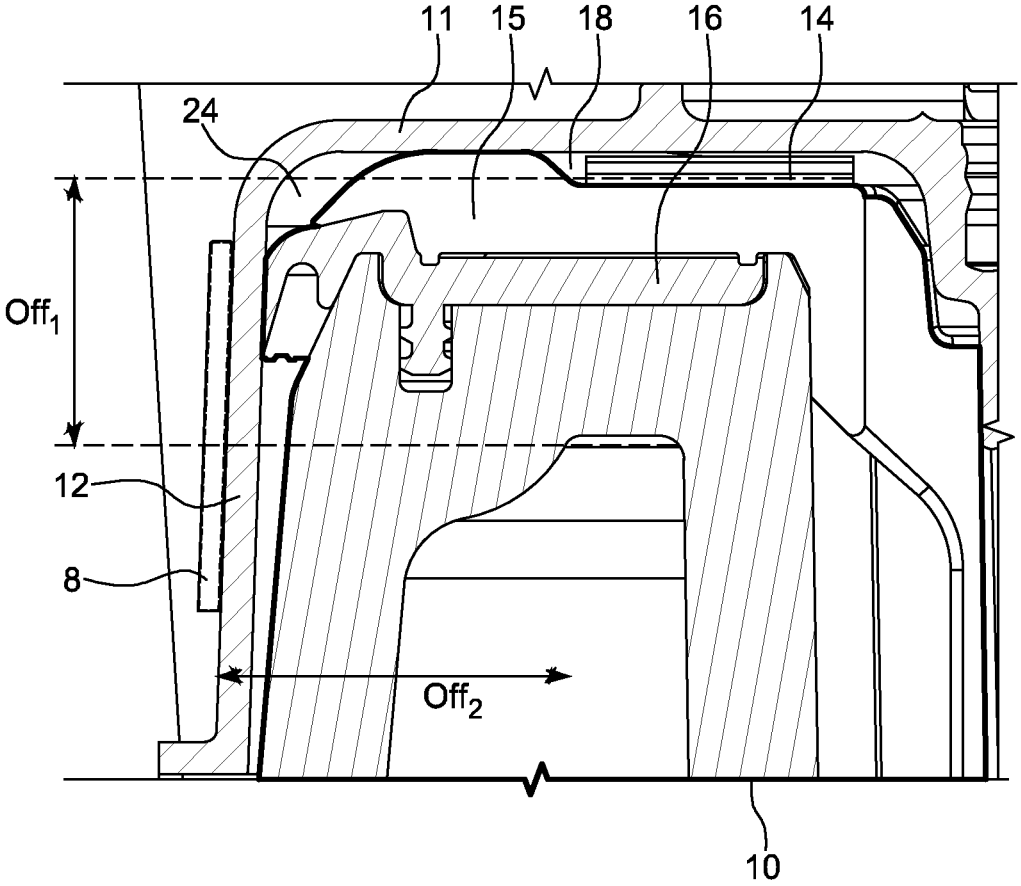
FIG. 1A shows a cross-section of an outer substantially annular gasket part of a base part of a pressure chamber inserted in a corresponding hollow annular space of a closure of a beverage container. The substantially annular gasket part comprises a substantially planar annular antenna arranged in a space between the annular keg gasket locking flange (15) and a top wall of the closure (12).

The present disclosure relates to radio-frequency identification-equipped pressure chamber for a beverage container, said pressure chamber comprising: a lid part; and a base part, said lid and said base part defining a sealed inner space for accommodating and encapsulating the beverage container. Preferably, the base part comprises an inner connector part adapted to be engaged to a corresponding beverage container outlet; and an outer substantially annular gasket part and surrounding the inner connector part. Together the inner connector part and the outer substantially annular gasket part may constitute a coupler, which, when engaging with the closure on the beverage container, forms a space sealed from the pressure chamber. Both the inner connector part and the outer substantially annular gasket part, i.e. the coupler, is, preferably, arranged on the inside of the base part, even more preferably at the bottom of the base part. The inside of the base part is defined as the inside of the pressure chamber, i.e. the sealed side, which is also the side towards the beverage container when the beverage container is encapsulated inside the pressure chamber. The outer substantially annular gasket part of the base part may be adapted to be engaged with a corresponding hollow annular space of a closure of the beverage container when placed inside the pressure chamber. In an alternative system, the lid part comprises a coupler which is preferably, arranged on the inside of the lid part, even more preferably at the bottom of the lid part. The inside of the lid part is defined as the inside of the pressure chamber, i.e. the sealed side, which is also the side towards the beverage container, in particular the beverage container outlet, when the beverage container is encapsulated inside the pressure chamber. The outer substantially annular gasket part of the lid part may be adapted to be engaged with a corresponding hollow annular space of a closure of the beverage container when placed inside the pressure chamber. The substantially planar annular antenna may, for example, be arranged between the keg gasket locking flange and the keg gasket.

When installed in a beverage dispensing system like the applicant's DraughtMaster™, the beverage container is typically oriented in a predetermined position such as an "upside down" position, i.e. the beverage container outlet is oriented in a downward direction. The coupler is typically rigid and suitable for supporting the weight of the beverage container. When installed in a beverage dispensing system, there is a fluid-tight connection between the beverage container outlet and a tapping line, alternatively the tapping line is already connected to the outlet in the keg prior to installation. The keg, which has a beverage container outlet, typically has a closure for cooperation with a coupler of a beverage dispensing system, either through the base part or the lid part. The beverage container may be equipped with an RFID tag, such as an NFC tag. Preferably, the RFID/NFC tag is arranged on the closure of the beverage container, such as on the outer rim of the closure. According to one embodiment of the presently disclosed RFID-equipped pressure chamber, the substantially annular gasket part of the coupler comprises a substantially planar annular antenna adapted to propagate radio waves to an RFID tag arranged on the beverage container, such as on the outer rim of the closure. WO2019/158562 describes the use of RFID tags on collapsible beverage containers.

The inventors have realized that rather than having an RFID tag and RFID interrogator on the outside of the pressure chamber, it would be possible and advantageous to integrate at least the interrogation antenna on the inside of the coupler located in base part or lid part, to facilitate maintenance and upgrading of systems. The inventors have also realized that by using a planar annular antenna and placing it on the substantially annular gasket part of the coupler in the pressure chamber, challenges related to the relative positioning with respect to the RFID tag and lack of space in the pressure chamber can be addressed. The present invention may thereby present a solution which takes into account both the geometry of the pressure chamber and beverage container and requirements related to magnetic field strengths at the RFID tag.

As is well-known in the art, RFID enables uniquely identifying items using radio waves. The NFC/RFID system comprises a reader and a tag. The reader, or interrogator, is a two-way radio transmitter-receiver that sends a radio frequency signal to the tag via an antenna, and the tag absorbs the frequency which causes it to become active and radiate back, and thereby respond with its unique information stored in the tag. Typically the interrogator has an interrogation antenna and the RFID tag has a target antenna. The RFID tag arranged on the collapsible container, such as on the closure of said container is preferably a passive RFID tag which is energized by radiation of the interrogator's radiated field (the antenna in the substantial annular gasket part in the pressure chamber). In the present disclosure, RFID tag refers to a transponder with a target antenna. According to one embodiment of the presently disclosed radio-frequency identification-equipped pressure chamber, the RFID tag is mounted on the rim of the closure of the beverage container. The interrogation part may have a substantially planar annular antenna, which shall be seen as the interrogation antenna. The interrogator part may further comprise an interrogation circuit/reader, which may be integrated in the substantially annular gasket part, such as integrated in the top section of the outer substantially annular gasket part, or integrated in a printed circuit board.

NFC is a specialized subset in RFID technology. Within the scope of the present disclosure, NFC shall be construed as a non-limiting embodiment of RFID. The RFID interrogator, RFID antenna, RFID tag and RFID tag antenna, may accordingly, but not necessarily be an NFC interrogator, NFC antenna, NFC tag and NFC tag antenna, respectively.

Physical Arrangements of Gasket Part (of Chamber), Closure Part (of Keg) and RFID Interrogator Antenna The collapsible beverage container may comprise a collapsible body and a closure with a beverage outlet configured for engagement with a connector of a beverage dispensing system. The closure may have an outer rim, such as a substantially cylindrical outer rim, and an inner rim, such as a substantially cylindrical inner rim. The closure may further comprise a top wall. The outlet of the container may be connected through an inner cylindrical or tubular connection inside the inner rim. This connection may comprise a valve or mechanisms for controlling the flow of the beverage. The inner connector part of the coupler is, preferably, adapted to be engaged to the beverage outlet. In a mounted configuration, wherein the keg is placed in the pressure chamber and connected to a tapping line, the inner connector part is, preferably, located inside the inner rim of the closure.

The outer substantially cylindrical rim, the substantially cylindrical inner rim and the top wall may define a hollow annular space of the closure, into which the outer substantially annular gasket part can be introduced in a sealed configuration.

The outer substantially annular gasket part may comprise a keg gasket locking flange, which may constitute a top section of the outer substantially annular gasket part, as shown in the example of FIG. 1A. The keg gasket locking flange may be of a substantially rigid material, such as plastic or rubber. Preferably, the keg gasket locking flange is configured to fit tightly to the inner rim of the closure in the sealed configuration. Beneath the keg gasket locking flange there may be a more resilient keg gasket. The keg gasket may be of a resilient material, or a material that is at least more resilient than that of the keg gasket locking flange.

Figure 1B:
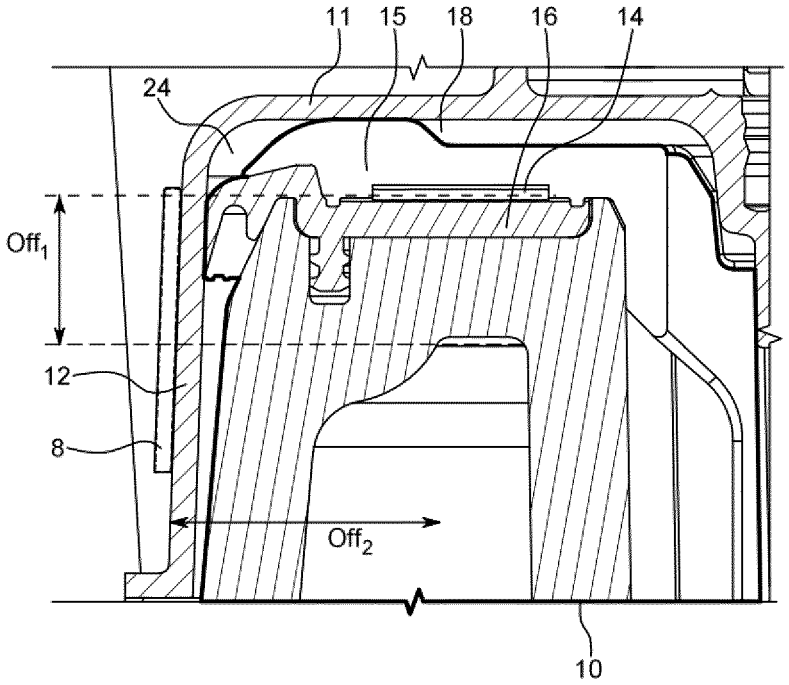
FIG. 1B shows a cross-section of an outer substantially annular gasket part of a base part of a pressure chamber inserted in a corresponding hollow annular space of a closure of a beverage container. The substantially annular gasket part comprises a substantially planar annular antenna arranged in a space between the annular keg gasket part (16) and keg gasket locking flange (15).

The substantially annular gasket part may have a top surface, i.e. a surface towards the keg in the mounted position. FIG. 1A may serve as an illustration of an example of a top surface 18 of the keg gasket locking flange (15) which constitutes the top section of a substantially annular gasket part 10. The top surface may have an annular inner section and an annular outer section. FIG. 1B may serve as an illustration of an example of a top surface of the keg gasket locking flange (15) which constitutes the top section of a substantially annular gasket part (10). The top surface has an annular inner section and an annular outer section. These sections are also exemplified in FIG. 2, wherein 19 is an annular inner section (surface) and 20 is an annular outer section (surface). The annular outer section may be arranged closer than the annular inner section to a top wall of the closure (11) in the sealed configuration. Thereby, the annular inner section of the top surface of the keg gasket locking flange and the top wall of the closure may define an antenna space for the substantially planar annular antenna in the sealed configuration. The substantially planar annular antenna does not necessarily have to be placed on top of the top surface. There may be an additional sheath over the antenna, such as a plastic sheath. Alternatively, the substantially planar antenna may be entirely integrated in the in the substantially annular gasket part, such as integrated in the top section of the outer substantially annular gasket part. In the example of FIG. 1, a substantially annular antenna space 21 is a space between the top wall of the closure and the annular inner section of the top surface. The substantially planar annular antenna may be arranged on the annular inner section of the top surface, or integrated in the outer substantially annular gasket part.

Substantially Planar Annular Antenna

The antenna may be designed to achieve certain minimum magnetic field strength requirements for the given physical constraints, i.e. the limitations in space and the position of the RFID tag. Two such standards are ISO/IEC 15693 and ISO/IEC 14443.

Preferably, the substantially planar annular antenna is integrated in a substantially planar annular printed circuit board and/or integrated in the substantially annular gasket part, such as integrated in the keg gasket locking flange and/or the top section of the outer substantially annular gasket part. As stated, the keg gasket locking flange may be made of a substantially rigid material, such as plastic or rubber, into which the substantially planar annular antenna may be molded or printed. The substantially planar annular printed circuit board may be adapted to fit in the antenna space. There may be an additional sheath over the antenna, such as a plastic sheath.

The substantially planar annular printed circuit board may further comprise an interrogation circuit and further required electronic components and circuits. The interrogation circuit and/or further required electronic components and circuits may be mounted on a printed circuit board or other base piece, such as a plastic piece, for holding the antenna and components together. The interrogation circuit, or, alternatively the base piece, and/or the entire assembly may be placed on the substantially annular gasket part and/or be integrated in the substantially annular gasket part, such as integrated in the keg gasket locking flange and/or the top section of the outer substantially annular gasket part.

The substantially planar annular antenna may be arranged with a first offset in height in relation to the radio-frequency identification tag on the keg and with a second offset in circumferential distance from the outer edge of the substantially planar annular antenna to the radio-frequency identification tag. The offset in height can be seen as the longitudinal extension of the keg and the pressure chamber in, for example, FIG. 4. Within the present disclosure, this may also be referred to as the Z dimension in a Cartesian coordinate system. The first offset may be seen as the distance between the substantially planar annular antenna and a center of the RFID tag in the Z dimension, as illustrated in FIG. 1. The first offset ($Off_1$) may be between 5.5 and 18.5 mm, such as between 5.5 mm and 15.5 mm, such as between 8.5 mm and 18.5 mm, preferably between 7.5 and 16.5, such as between 7.5 and 13.5, such as between 10.5 mm and 16.5 mm, such as 13.5 mm and in particular 10.5 mm.

The second offset can be seen as the distance between the substantially planar annular antenna and the RFID tag in the X-Y dimension, i.e. in the extension of the planar antenna, as illustrated in FIG. 1. The second offset ($Off_2$) may be between 10.7 mm and 22.7 mm, preferably between 13.7 mm and 19.7 mm, such as 16.7 mm.

In one embodiment of the presently disclosed radio-frequency identification-equipped pressure chamber, the substantially planar annular antenna and the radio-frequency identification tag extend in substantially orthogonal directions, as illustrated in FIG. 1. Preferably, the substantially planar annular antenna is configured to generate a magnetic field component orthogonal to the radio-frequency identification tag, wherein the magnetic field component has a local maximum at the radio-frequency identification tag.

The substantially planar annular antenna may have a substantially circular shape. The substantially planar annular may therefore have a substantially circular inner edge and a substantially circular outer edge. The antenna may take a number of shapes in terms of, for example, number of turns. The substantially planar annular antenna may be a spiral antenna, such as a two turn spiral antenna, a single turn antenna or a two turn antenna, the substantially planar annular antenna having an outer diameter $d_{out}$ and an inner diameter $d_{in}$. Preferably, the outer diameter $d_{out}$ and an inner diameter $d_{in}$ are selected such that the antenna is in compliance with the dimensions of the pressure chamber and keg (i.e. available space), the position of the RFID tag, as well as the requirements on the generated magnetic field at the RFID tag in order to comply with standards, such as are ISO/IEC 15693 and ISO/IEC 14443. Taking into account the above requirements and preferences, the outer diameter of the substantially planar annular antenna may be between 70 mm and 110 mm, preferably between 80 mm and 100 mm, more preferably between 87 mm and 97 mm, such as 92 mm.

Preferably, the design of the antenna is selected such that the magnetic field is maximized outside the antenna in the X-Y dimension at the distance of the RFID tag in the X-Y plane, since the RFID tag may be located circumferentially outside the antenna on the outer rim of the closure.

Trace width and spacing are parameters of planar antennas, such as the substantially planar annular antenna of the presently disclosed radio-frequency identification-equipped pressure chamber. The substantially planar annular antenna may be a spiral antenna. The spiral antenna may have a trace width w between 0.3 mm and 0.7 mm, such as 0.5 mm and a trace space g between 0.3 mm and 0.7 mm, such as 0.5 mm.

Figure 3A:
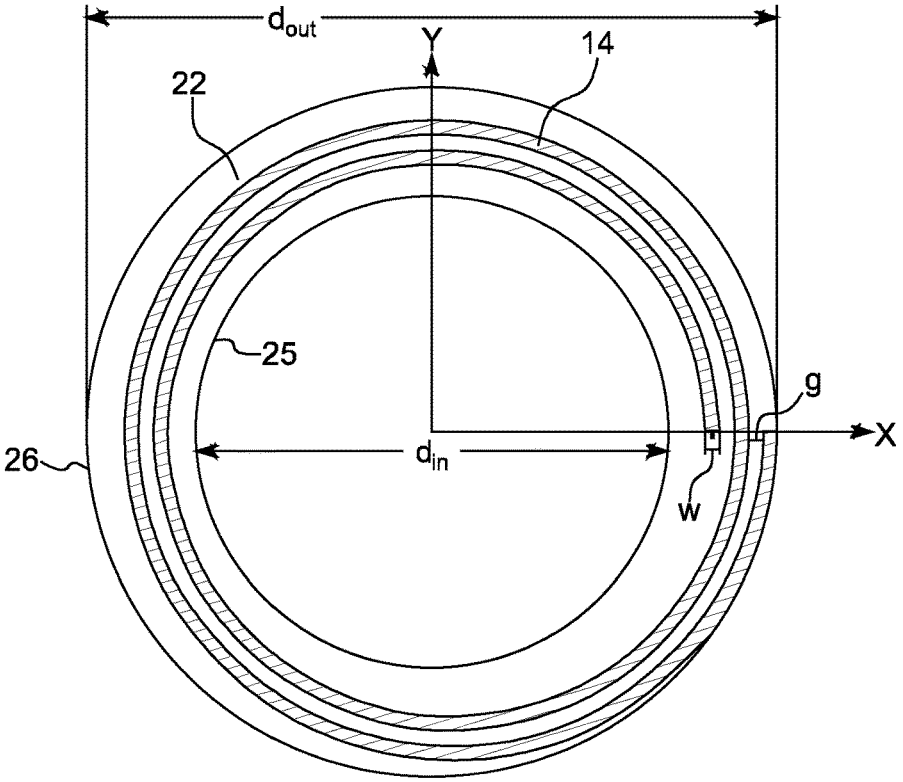
FIG. 3 show embodiments of a substantially planar annular antenna integrated in a base piece, such as a piece of plastic or a printed circuit board.
Figure 3B:
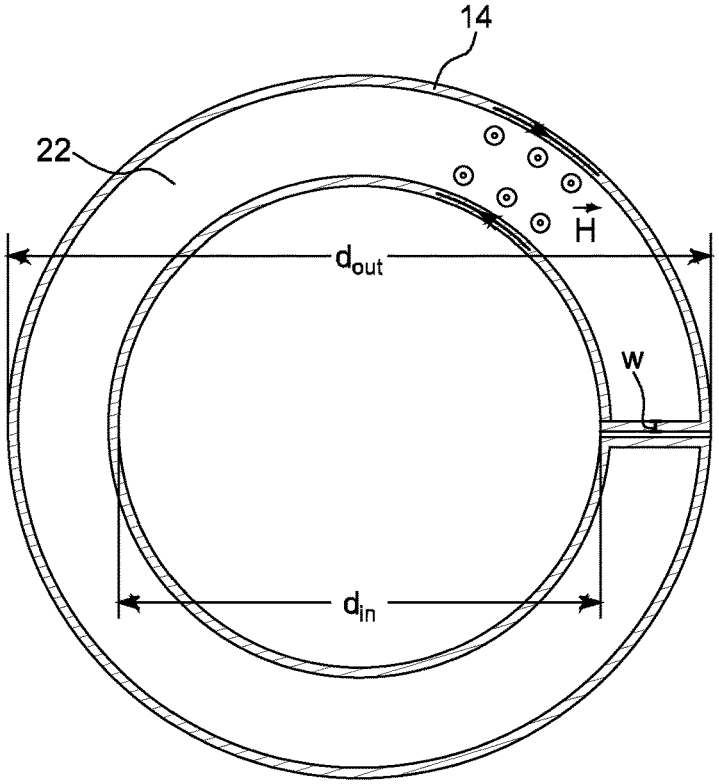

If the substantially planar annular antenna is a single turn antenna, it may have a trace width w of 1 mm and form a loop along the outer diameter $d_{out}$ and an inner diameter $d_{in}$ of the substantially planar annular antenna, as shown in the example of FIG. 3B.

In the embodiment wherein the substantially planar annular antenna is a two turn antenna, the two turn antenna may have a trace width w between 0.3 mm and 0.7 mm, such as 0.5 mm, and a trace space g between 0.2 mm and 0.7 mm, such as 0.5 mm, and wherein the two turns form a loop along the outer diameter $d_{out}$ and an inner diameter $d_{in}$ of the substantially planar annular antenna. The two turns may be wrapped along a line orthogonal to the substantially circular inner edge and substantially circular outer edge.

Figure 3C:
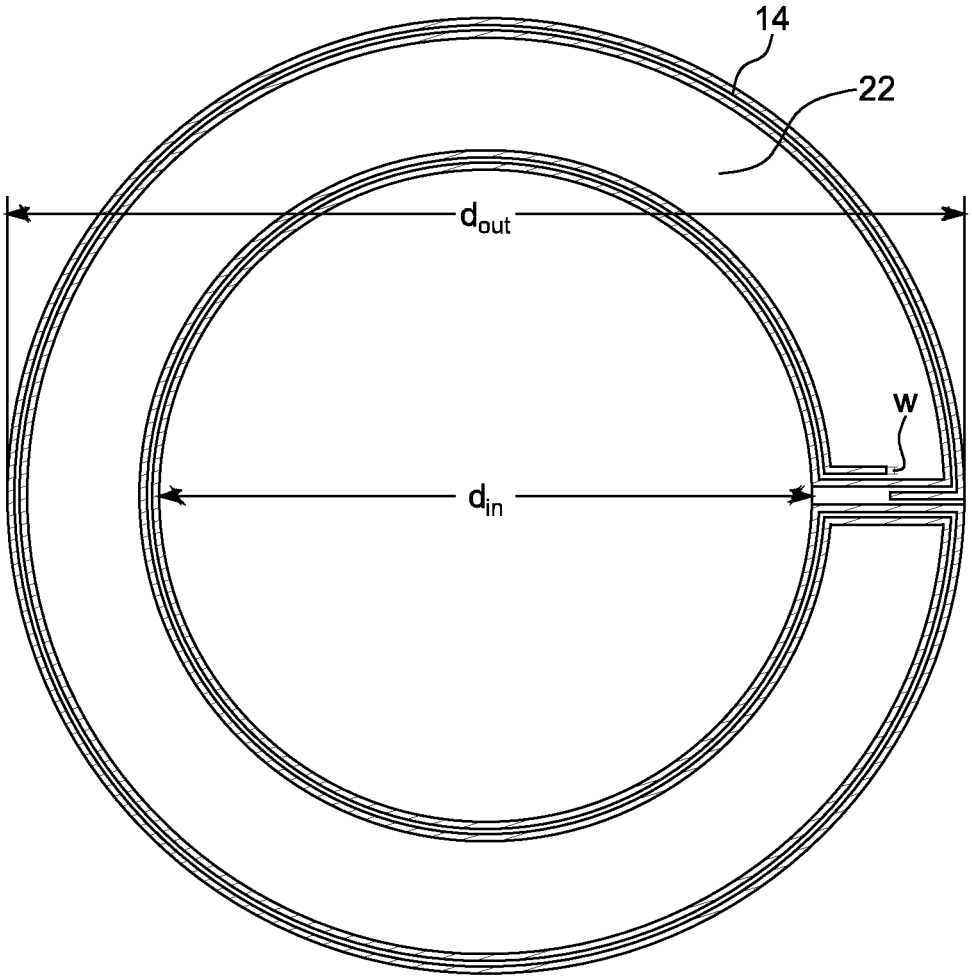

FIGS. 3A, 3B and 3C show embodiments of a substantially planar annular antenna. FIG. 3A shows a spiral antenna. FIG. 3B shows a single turn antenna. FIG. 3C shows a two turn antenna.

Example of FIG. 3A: spiral antenna: Flat spiral antennas are known for their planar designed suitable for integration in, for example, a printed circuit board. Since the orientation of the plane where the tag antenna lies is orthogonal in relation to the plane of the reader antenna, the importance of the vertical component (Z-axis) of the field is limited as it does not produce the magnetic flux in the tag. The component that creates a net magnetic flux on the tag can be thought off as the curling behavior of the produced magnetic field at the center of the coil.

Example of FIG. 3B: single turn antenna: In this embodiment the field is created closer to the periphery of the antenna where the RFID/NFC tag is located. The magnetic field is produced in the middle of the two traces of the antenna by two opposing currents as shown in FIG. 3B.

Example of FIG. 3C: two turn antenna: In this embodiment the two turns form a loop along the outer diameter $d_{out}$ and an inner diameter $d_{in}$ of the substantially planar annular antenna.

Matching Network

The radio-frequency identification-equipped pressure chamber may further comprise a matching network, which is typically placed between the interrogation circuit and the antenna. RF transmission lines have a characteristic impedance, which is a factor in RF circuitry. Preferably, impedances are matched to prevent standing waves and to ensure efficient transfer of power from source to load. It is desirable that the antenna is impedance matched in the operation environment so that it operates in the desired frequency band with maximum efficiency within the RFID spectrum of 125 kHz-5.4 GHz. For the presently disclosed radio-frequency identification-equipped pressure chamber, which may operate at e.g. 13.56 MHz, a matching network may be designed according to the example of FIG. 4.

Pressure System

The disclosure further relates to a pressure system for a beverage comprising the presently disclosed radio-frequency identification-equipped pressure chamber and a collapsible beverage container having a radio-frequency identification tag. The radio-frequency identification-equipped pressure may be any of the above embodiments.

The pressure system can thereby be seen as an assembly comprising a collapsible beverage container and a pressure chamber for accommodating and encapsulating the collapsible beverage container. The pressure system may be part of a beverage dispensing system in the form of a modular system comprising a plurality of collapsible beverage containers and pressure chambers sharing a common tapping line.

In particular, the pressure chamber of the pressure system may comprise:

- a lid part; and
- a base part, said lid and said base part defining a sealed inner space for accommodating and encapsulating the collapsible beverage container, said base part comprising:
  - an inner connector part adapted to be engaged to the beverage outlet, said inner connector part arranged on an inside of the base part; and
  - an outer substantially annular gasket part arranged on the inside of the base part and surrounding the inner connector part, said outer substantially annular gasket part adapted to be engaged with a corresponding hollow annular space of the closure of the collapsible beverage container, the substantially annular gasket part comprising a substantially planar annular antenna adapted to propagate radio waves to the radio-frequency identification tag.

Alternatively, the inner connector part may be arranged on an inside of the lid part, and the outer substantially annular gasket part may be arranged on the inside of the lid part.

The collapsible beverage container preferably comprise a closure with a beverage outlet. In a preferred embodiment, the closure has an outer rim and a radio-frequency identification tag arranged on said rim. In one embodiment, the closure has an outer substantially cylindrical outer rim and a substantially cylindrical inner rim. The outlet of the collapsible container may be connected through an inner cylindrical or tubular connection inside the inner rim. The closure may further comprise a top wall covering at least the annular section defined by the inner rim and the outer rim. The outer rim, inner rim and top wall may thereby define the hollow annular space of the closure.

When assembled the RFID tag on the collapsible container and the interrogation antenna and reader will enable monitoring useful information about the status of the pressure chamber and the keg itself, thereby increasing safety of the beverage dispensing system. The system can transmit and process information, in particular the system can process and store information about the beverage in the collapsible container both in terms of brand (content), remaining volume, days on the tap and so forth. The pressure status of the chamber can likewise be monitored, and a pressure drop to zero can be used to indicate that a new collapsible beverage container has been inserted into the system.

DETAILED DESCRIPTION OF DRAWINGS

The invention will in the following be described in greater detail with reference to the accompanying drawings. The drawings are exemplary and are intended to illustrate some of the features of the presently disclosed radio-frequency identification-equipped pressure chamber and pressure system for a beverage, and are not to be construed as limiting to the presently disclosed invention.

FIG. 1A shows a cross-section of an outer substantially annular gasket part (10) of a base part or lid part of a pressure chamber inserted in a corresponding hollow annular space (24) of a closure of a beverage container. The substantially annular gasket part (10) comprises a substantially planar annular antenna (14) arranged in a space between the annular gasket part (10) and a top wall (11) of the closure. The closure has, besides the top wall (10) an outer rim (12), on which an RFID tag (8) is arranged, and an inner rim (13). The substantially annular gasket part (10) comprises a keg gasket locking flange (15), which constitutes a top section of the outer substantially annular gasket part (10). Under the keg gasket locking flange (15), there is a, preferably resilient, keg gasket (16). The keg gasket locking flange (15) has a top surface (18) towards the top wall (11) of the closure. In FIG. 1B the substantially planar annular antenna (14) arranged between the annular keg gasket part (16) and keg gasket locking flange (15).

Figure 2:
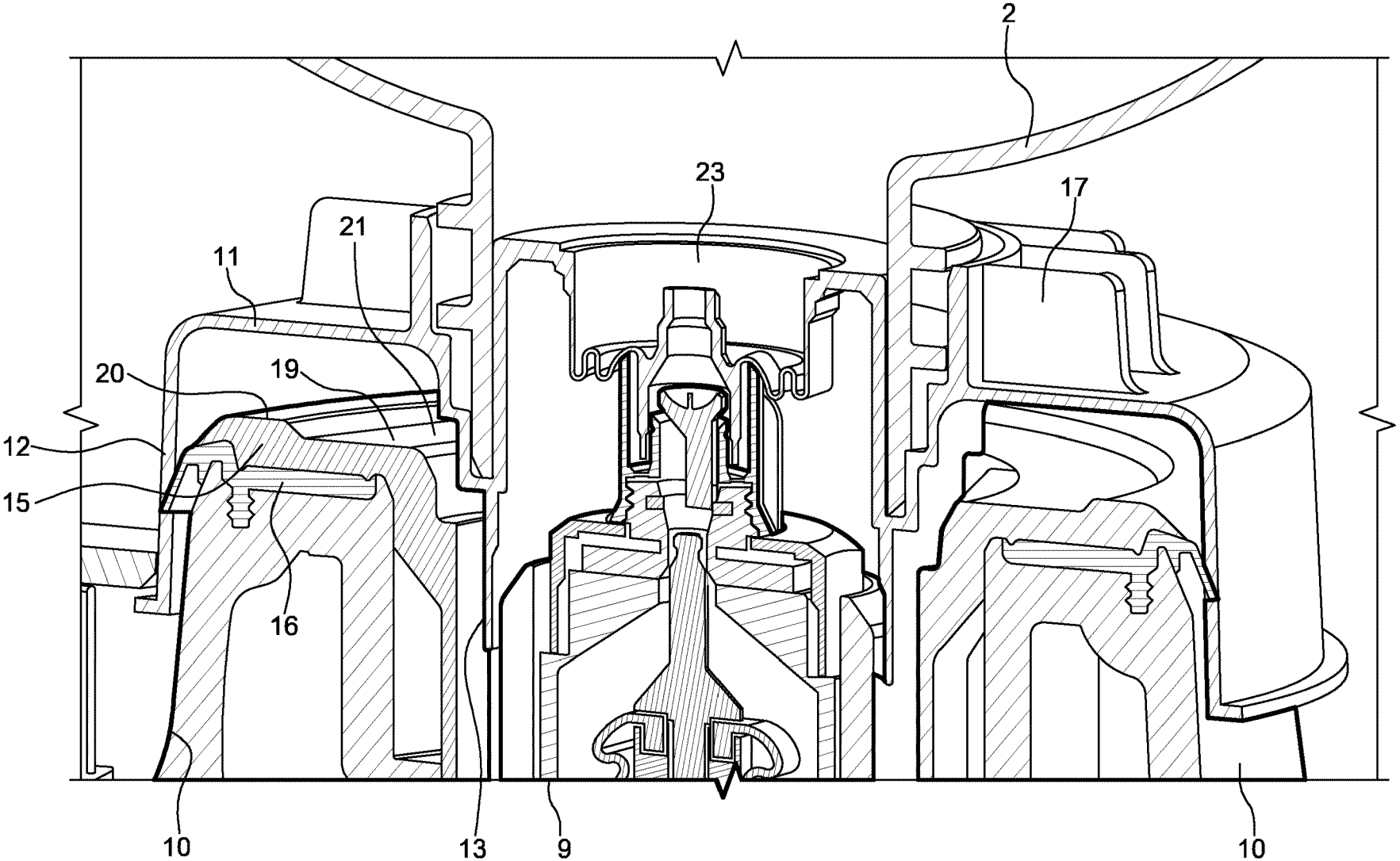
FIG. 2 shows a cross-section of an outer substantially annular gasket part of a base part of a pressure chamber partly inserted in a closure of a keg.

FIG. 2 shows a cross-section of an outer substantially annular gasket part (10) of a base part (5) or lid part of a pressure chamber (1) partly inserted in a closure (17) of a keg (2). The substantially planar annular antenna and RFID tag are not mounted in FIG. 2. The substantially planar annular antenna can be mounted in the antenna space (21). The substantially annular gasket part (10) comprises a keg gasket locking flange (15), which constitutes a top section of the outer substantially annular gasket part (10). Under the keg gasket locking flange (15), there is a, preferably resilient, keg gasket (16). The annular antenna may be arranged between these two sections for maximum protection (illustrated in FIG. 1B). The keg gasket locking flange (15) has a top surface (18) towards the top wall (11) of the closure (17). The top surface of the outer substantially annular gasket part (10) has an annular inner section (19) and an annular outer section (20). The substantially planar annular antenna (not visible in FIG. 2) may alternatively be arranged on the annular outer section (20), optionally covered by a sheath, or, optionally integrated in, such as molded into, the substantially annular gasket part (10). The base part (5) of the pressure chamber (1) comprises an inner connector part (9) adapted to be engaged to a corresponding beverage container outlet (23). The closure (17) has, besides the top wall (10) an outer rim (12), on which an RFID tag (not visible in FIG. 2) may be arranged, and an inner rim (13).

FIG. 3A shows an embodiment of a substantially planar annular antenna (14), in the form of a spiral antenna, integrated in a base piece (22), such as a printed circuit board or a piece of plastic. The substantially planar annular antenna (14) has a substantially circular inner edge (25) and a substantially circular outer edge (26). The substantially planar annular antenna (14) has an outer diameter $d_{out}$ and an inner diameter $d_{in}$.

FIG. 3B shows an embodiment of a substantially planar annular antenna (14), in the form of a single turn antenna. The substantially planar annular antenna (14) has an outer diameter $d_{out}$ and an inner diameter $d_{in}$.

FIG. 3C shows an embodiment of a substantially planar annular antenna (14), in the form of a two turn antenna. The substantially planar annular antenna (14) has an outer diameter $d_{out}$ and an inner diameter $d_{in}$. The two turns form a loop along the outer diameter $d_{out}$ and an inner diameter $d_{in}$ of the substantially planar annular antenna. The two turns are wrapped along a line orthogonal to the substantially circular inner edge and substantially circular outer edge.

Figure 4:
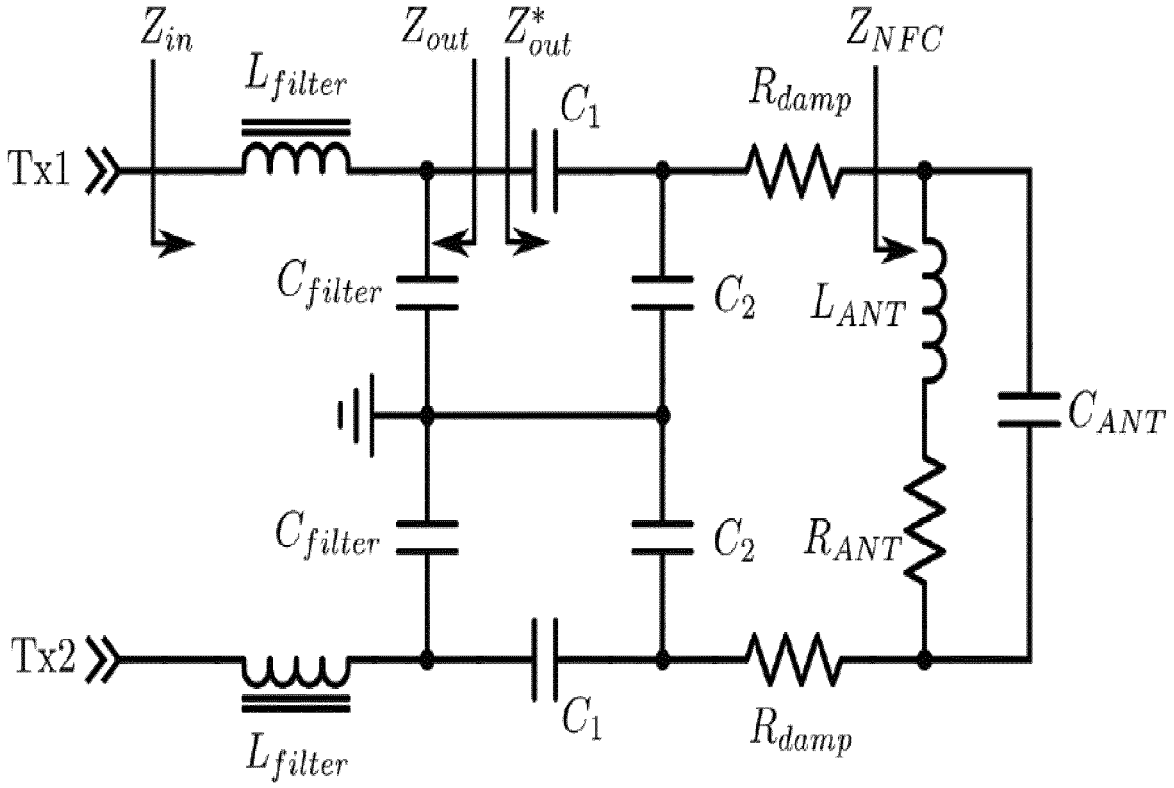
FIG. 4 shows an example of a simplified schematic of a matching network for the presently disclosed radio-frequency identification-equipped pressure chamber.

FIG. 4 shows an example of a simplified schematic of a matching network for the presently disclosed radio-frequency identification-equipped pressure chamber.

Figure 5:
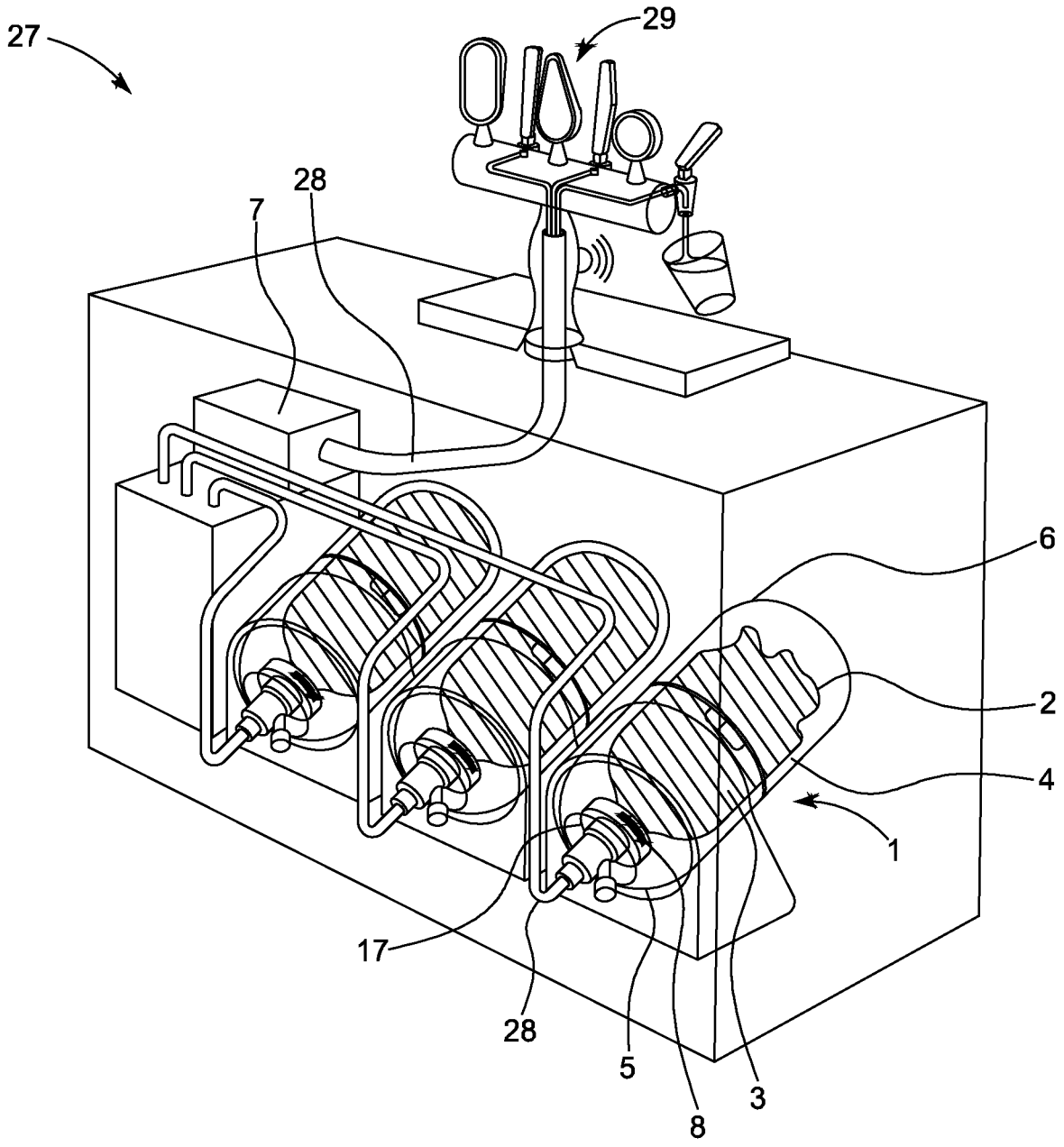
FIG. 5 shows a beverage dispensing system as a modular system comprising three pressure chambers with collapsible beverage filled containers.
Figure 6:
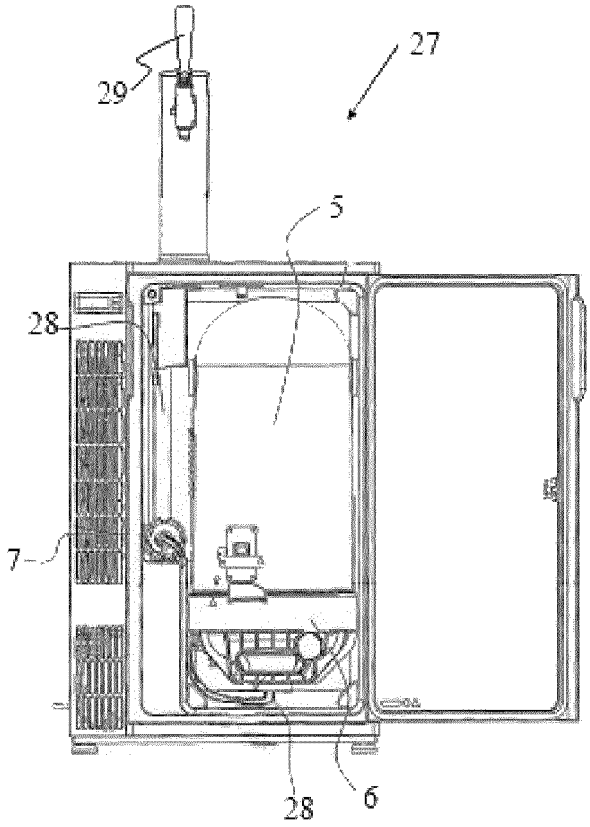
FIG. 6 shows a beverage dispensing system as a flex system comprising one pressure chamber where the closure of the beverage container is inserted into the lid part of the pressure chamber when assembled.
Figure 7:
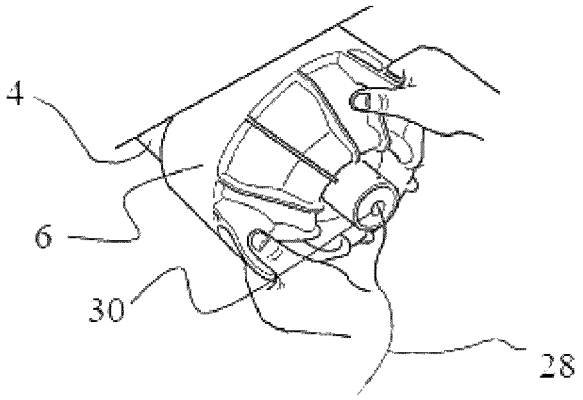
FIG. 7 shows an embodiment in which the tapping line is in fluid communication with the outlet of the beverage container through the lid of the pressure chamber, where the inside of the lid comprises elements similar to those disclosed in FIGS. 1A and 1B.

FIG. 5 shows a perspective view of a modular beverage dispensing system (27) comprising three pressure chambers (1) with collapsible beverage-filled containers (2). The pressure chambers (1) each comprise a rigid base part (5) and a lid part (6). The beverage container (2), also known as keg, is of the collapsible type made of a collapsible polymeric material, thus the term collapsible beverage container. The collapsible beverage container (2) defines a beverage filled space containing the beverage (3), typically being a carbonated beverage such as beer. The beverage container (2) may also comprise a gas filled head space at its top portion, above the level of the beverage inside the beverage container (2). The lid part (6) and the rigid base part (5) are separable, but during operation, they are sealed together for defining the inner space (4) for accommodating the beverage container (2). The lid part (6) may e.g. be made of rubber. The collapsible beverage container (2) includes a closure (17) for cooperation with a coupler of a beverage dispensing system (27) through the base part (5), thereby connecting the collapsible beverage container (2) to a tapping line (28). The tapping line (28) passes through a cooling device (7) and further on to a tapping device (29).

REFERENCE NUMERALS

1—radio-frequency identification-equipped pressure chamber
2—beverage container
3—beverage
4—sealed inner space
5—base part
6—lid part
7—cooling device
8—RFID-tag
9—inner connector part of the coupler
10—outer substantially annular gasket part of the coupler
11—top wall (of closure)
12—outer rim (of closure)
13—inner rim (of closure)
14—substantially planar annular antenna (interrogation antenna)
15—keg gasket locking flange
16—keg gasket
17—closure
18—top surface (of keg gasket locking flange (15))
19—annular inner section (of keg gasket locking flange (15))
20—annular outer section (of keg gasket locking flange (15))
21—antenna space
22—base piece/printed circuit board (interrogation reader)
23—beverage container outlet
24—hollow annular space
25—inner edge (of substantially planar annular antenna)
26—outer edge (of substantially planar annular antenna)
27—beverage dispensing system
28—tapping line
29—tapping device
30—tapping line opening in lid

FURTHER DETAILS OF THE INVENTION

1. A radio-frequency identification-equipped pressure chamber for a beverage container, said pressure chamber comprising:
   a lid part;
   a base part, said lid and said base part defining a sealed inner space for accommodating and encapsulating said beverage container, said base part comprising:
   an inner connector part adapted to be engaged to a corresponding beverage container outlet, said inner connector part arranged on an inside of the base part; and
   an outer substantially annular gasket part arranged on the inside of the base part and surrounding the inner connector part, said outer substantially annular gasket part adapted to be engaged with a corresponding hollow annular space of a closure of the beverage container, the substantially annular gasket part comprising a substantially planar annular antenna adapted to propagate radio waves to a radio-frequency identification tag arranged of an outer rim of the closure.
2. A radio-frequency identification-equipped pressure chamber for a beverage container, said pressure chamber comprising:
   a lid part;
   a base part, said lid and said base part defining a sealed inner space for accommodating and encapsulating said beverage container, said lid comprising:
   an inner connector part adapted to be engaged to a corresponding beverage container outlet, said inner connector part arranged on an inside of the lid part; and
   an outer substantially annular gasket part arranged on the inside of the lid part and surrounding the inner connector part, said outer substantially annular gasket part adapted to be engaged with a corresponding hollow annular space of a closure of the beverage container, the substantially annular gasket part comprising a substantially planar annular antenna adapted to propagate radio waves to a radio-frequency identification tag arranged of an outer rim of the closure.
3. The radio-frequency identification-equipped pressure chamber according to any of the preceding items, wherein the outer substantially annular gasket part is shaped to be introduced into the corresponding hollow annular space of the closure of the beverage container into a sealed configuration.
4. The radio-frequency identification-equipped pressure chamber according to item 3, wherein the outer substantially annular gasket part comprises a top surface having an annular inner section and an annular outer section, wherein the annular outer section is arranged closer than the annular inner section to a top wall of the closure in the sealed configuration.

5. The radio-frequency identification-equipped pressure chamber according to item 4, wherein the annular inner section of the top surface and the top wall of the closure define an antenna space for the substantially planar annular antenna in the sealed configuration.
6. The radio-frequency identification-equipped pressure chamber according to any of items 4-5, wherein the antenna space is substantially annular.
7. The radio-frequency identification-equipped pressure chamber according to any of items 4-6, wherein the substantially planar annular antenna is arranged on the annular inner section of the top surface.
8. The radio-frequency identification-equipped pressure chamber according to any of the preceding items, wherein the outer substantially annular gasket part comprises a keg gasket locking flange, the keg gasket locking flange constituting a top section of the outer substantially annular gasket part.
9. The radio-frequency identification-equipped pressure chamber according to item 8, wherein the keg gasket locking flange is made of a substantially rigid material, such as plastic or rubber.
10. The radio-frequency identification-equipped pressure chamber according to any of items 8-9, wherein the keg gasket locking flange is configured to fit tightly to an inner rim of the closure in the sealed configuration.
11. The radio-frequency identification-equipped pressure chamber according to any of items 8-10, wherein the outer substantially annular gasket part further comprises a keg gasket arranged under the keg gasket locking flange.
12. The radio-frequency identification-equipped pressure chamber according to item 11, wherein keg gasket is made of a resilient material, or a material more resilient than that of the keg gasket locking flange.
13. The radio-frequency identification-equipped pressure chamber according to any of the preceding items, wherein the inner connector part is substantially cylindrical.
14. The radio-frequency identification-equipped pressure chamber according to any of the preceding items, wherein the substantially planar annular antenna is integrated in a substantially planar annular printed circuit board and/or integrated in the substantially annular gasket part, such as integrated in the top section of the outer substantially annular gasket part.
15. The radio-frequency identification-equipped pressure chamber according to items 5 and 14, wherein the substantially planar annular printed circuit board is adapted to fit in the antenna space.
16. The radio-frequency identification-equipped pressure chamber according to any of item 14-15, wherein the substantially planar annular printed circuit board further comprises an interrogation circuit, and/or wherein an interrogation circuit is integrated in the substantially annular gasket part, such as integrated in the top section of the outer substantially annular gasket part.
17. The radio-frequency identification-equipped pressure chamber according to any of the preceding items, wherein the substantially planar annular antenna is an omnidirectional antenna.
18. The radio-frequency identification-equipped pressure chamber according to any of the preceding items, wherein the substantially planar annular antenna has a substantially circular inner edge and a substantially circular outer edge.
19. The radio-frequency identification-equipped pressure chamber according to any of the preceding items, wherein the substantially planar annular antenna is a spiral antenna, such as a two turn spiral antenna, a single turn antenna or a two turn antenna, the substantially planar annular antenna having an outer diameter $d_{out}$ and an inner diameter $d_{in}$.
20. The radio-frequency identification-equipped pressure chamber according to item 19, wherein the outer diameter is between 70 mm and 110 mm, preferably between 80 mm and 100 mm, more preferably between 87 mm and 97 mm, such as 92 mm.
21. The radio-frequency identification-equipped pressure chamber according to any of items 18-19, wherein the spiral antenna has a trace width w between 0.3 mm and 0.7 mm, such as 0.5 mm and a trace space g between 0.3 mm and 0.7 mm, such as 0.5 mm.
22. The radio-frequency identification-equipped pressure chamber according to any of items 18-19, wherein the single turn antenna has a trace width w of 1 mm and forms a loop along the outer diameter $d_{out}$ and an inner diameter $d_{in}$ of the substantially planar annular antenna.
23. The radio-frequency identification-equipped pressure chamber according to any of items 18-19, wherein the two turn antenna has a trace width w between 0.3 mm and 0.7 mm, such as 0.5 mm, and a trace space g between 0.2 mm and 0.7 mm, such as 0.5 mm, and wherein the two turns form a loop along the outer diameter $d_{out}$ and an inner diameter $d_{in}$ of the substantially planar annular antenna.
24. The radio-frequency identification-equipped pressure chamber according to item 23, wherein the two turns are wrapped along a line orthogonal to the substantially circular inner edge and substantially circular outer edge.
25. The radio-frequency identification-equipped pressure chamber according to any of the preceding items, wherein substantially planar annular antenna is arranged with a first offset in height in relation to the radio-frequency identification tag and with a second offset in circumferential distance from the outer edge of the substantially planar annular antenna to the radio-frequency identification tag.
26. The radio-frequency identification-equipped pressure chamber according to item 25, wherein the first offset is between 8.5 mm and 18.5 mm, preferably between 10.5 mm and 16.5 mm, such as 13.5 mm.
27. The radio-frequency identification-equipped pressure chamber according to any of items 25-26, wherein the second offset is between 10.7 mm and 22.7 mm, preferably between 13.7 mm and 19.7 mm, such as 16.7 mm
28. The radio-frequency identification-equipped pressure chamber according to any of the preceding items, wherein the substantially planar annular antenna and the radio-frequency identification tag extend in substantially orthogonal directions, and wherein the substantially planar annular antenna is arranged to generate a magnetic field component orthogonal to the radio-frequency identification tag, wherein the magnetic field component has a local maximum at the radio-frequency identification tag.
29. The radio-frequency identification-equipped pressure chamber according to any of the preceding items, wherein the radio-frequency identification is near-field communication and the radio-frequency identification tag is a near-field communication tag.

30. A pressure system for a beverage comprising:
a collapsible beverage container comprising a closure with a beverage outlet, the closure having an outer rim and a radio-frequency identification tag arranged on said rim;
a pressure chamber comprising:
a lid part;
a base part, said lid and said base part defining a sealed inner space for accommodating and encapsulating the collapsible beverage container, said base part comprising:
an inner connector part adapted to be engaged to the beverage outlet, said inner connector part arranged on an inside of the base part; and
an outer substantially annular gasket part arranged on the inside of the base part and surrounding the inner connector part, said outer substantially annular gasket part adapted to be engaged with a corresponding hollow annular space of the closure of the collapsible beverage container, the substantially annular gasket part comprising a substantially planar annular antenna adapted to propagate radio waves to the radio-frequency identification tag.

31. A pressure system for a beverage comprising:
a collapsible beverage container comprising a closure with a beverage outlet, the closure having an outer rim and a radio-frequency identification tag arranged on said rim;
a pressure chamber comprising:
a lid part;
a base part, said lid and said base part defining a sealed inner space for accommodating and encapsulating the collapsible beverage container, said lid part comprising:
an inner connector part adapted to be engaged to the beverage outlet, said inner connector part arranged on an inside of the lid part; and
an outer substantially annular gasket part arranged on the inside of the lid part and surrounding the inner connector part, said outer substantially annular gasket part adapted to be engaged with a corresponding hollow annular space of the closure of the collapsible beverage container, the substantially annular gasket part comprising a substantially planar annular antenna adapted to propagate radio waves to the radio-frequency identification tag.

32. The pressure system according to item 30, wherein the radio-frequency identification-equipped pressure chamber according to any of items 1-29.

33. The pressure system according to any of items 30-32, wherein the closure has an outer substantially cylindrical outer rim; a substantially cylindrical inner rim; and a top wall.

34. The pressure system according to item 33, wherein the outer substantially cylindrical outer rim, the substantially cylindrical inner rim and the top wall define the hollow annular space of the closure.

The invention claimed is:

1. A radio-frequency identification-equipped pressure chamber for a beverage container, said pressure chamber comprising:
a lid part;
a base part, said lid and said base part defining a sealed inner space for accommodating and encapsulating said beverage container, said base part or lid part comprising:
an inner connector part adapted to be engaged to a corresponding beverage container outlet, said inner connector part arranged on an inside of the base part or lid part; and
an outer substantially annular gasket part arranged on the inside of the base part or lid part and surrounding the inner connector part, said outer substantially annular gasket part adapted to be engaged with a corresponding hollow annular space of a closure of the beverage container, the outer substantially annular gasket part comprising a substantially planar annular antenna adapted to propagate radio waves to a radio-frequency identification tag arranged on an outer rim of the closure.

2. The radio-frequency identification-equipped pressure chamber according to claim 1, wherein the outer substantially annular gasket part is shaped to be introduced into the corresponding hollow annular space of the closure of the beverage container into a sealed configuration.

3. The radio-frequency identification-equipped pressure chamber according to claim 2, wherein the outer substantially annular gasket part comprises a top surface having an annular inner section and an annular outer section, wherein the annular outer section is arranged closer than the annular inner section to a top wall of the closure in the sealed configuration, and wherein the annular inner section of the top surface and the top wall of the closure define an antenna space for the substantially planar annular antenna in the sealed configuration.

4. The radio-frequency identification-equipped pressure chamber according to claim 1, wherein the outer substantially annular gasket part comprises a keg gasket locking flange, the keg gasket locking flange constituting a top section of the outer substantially annular gasket part and wherein the substantially planar annular antenna is integrated in said top section.

5. The radio-frequency identification-equipped pressure chamber according to claim 4, wherein the outer substantially annular gasket part further comprises a keg gasket arranged under the keg gasket locking flange.

6. The radio-frequency identification-equipped pressure chamber according to claim 5, wherein the substantially planar annular antenna is arranged between the keg gasket locking flange and the keg gasket.

7. The radio-frequency identification-equipped pressure chamber according to claim 1, wherein the substantially planar annular antenna is integrated in a substantially planar annular printed circuit board.

8. The radio-frequency identification-equipped pressure chamber according to claim 1, wherein the substantially planar annular antenna has a substantially circular inner edge and a substantially circular outer edge, wherein the substantially planar annular antenna is a spiral antenna, the substantially planar annular antenna having an outer diameter $d_{out}$ and an inner diameter $d_{in}$.

9. The radio-frequency identification-equipped pressure chamber according to claim 1, wherein substantially planar annular antenna is arranged with a first offset in height in relation to the radio-frequency identification tag and with a second offset in circumferential distance from the outer edge of the substantially planar annular antenna to the radio-frequency identification tag.

10. The radio-frequency identification-equipped pressure chamber according to claim 9, wherein the first offset is between 5.5 mm and 15.5 mm, or between 7.5 mm and 13.5 mm.

11. The radio-frequency identification-equipped pressure chamber according to claim 9, wherein the second offset is between 10.7 mm and 22.7 mm, or between 13.7 mm and 19.7 mm.

12. The radio-frequency identification-equipped pressure chamber according to claim 1, wherein the substantially planar annular antenna and the radio-frequency identification tag extend in substantially orthogonal directions, and wherein the substantially planar annular antenna is arranged to generate a magnetic field component orthogonal to the radio-frequency identification tag, wherein the magnetic field component has a local maximum at the radio-frequency identification tag.

13. The radio-frequency identification-equipped pressure chamber according to claim 1, wherein the radio-frequency identification is near-field communication and the radio-frequency identification tag is a near-field communication tag.

14. A pressure system for a beverage comprising:

a collapsible beverage container comprising a closure with a beverage outlet, the closure having an outer rim and a radio-frequency identification tag arranged on said rim;

a pressure chamber comprising:

a lid part;

a base part, said lid and said base part defining a sealed inner space for accommodating and encapsulating the collapsible beverage container, said base part or lid part comprising:

an inner connector part adapted to be engaged to the beverage outlet, said inner connector part arranged on an inside of the base part or lid part; and an outer substantially annular gasket part arranged on the inside of the base part or lid part and surrounding the inner connector part, said outer substantially annular gasket part adapted to be engaged with a corresponding hollow annular space of the closure of the collapsible beverage container, the outer substantially annular gasket part comprising a substantially planar annular antenna adapted to propagate radio waves to the radio-frequency identification tag.

15. The radio-frequency identification-equipped pressure chamber according to claim 5, wherein the keg gasket is made of a resilient material, or of a material more resilient than that of the keg gasket locking flange.

16. The radio-frequency identification-equipped pressure chamber according to claim 8, wherein the substantially planar annular antenna is a two turn spiral antenna, a single turn antenna or a two turn antenna.

17. The radio-frequency identification-equipped pressure chamber according to claim 16, wherein the two turn antenna has a trace width w between 0.3 mm and 0.7 mm, or at 0.5 mm, and a trace space g between 0.2 mm and 0.7 mm, or at 0.5 mm, and wherein the two turns form a loop along the outer diameter $d_{out}$ and an inner diameter $d_{in}$ of the substantially planar annular antenna.

18. The radio-frequency identification-equipped pressure chamber according to claim 9, wherein the first offset is 10.5 mm.

19. The radio-frequency identification-equipped pressure chamber according to claim 9, wherein the second offset is 16.7 mm.

* * * * *